United States Patent [19]

Thomas

[11] 4,359,828

[45] Nov. 23, 1982

[54] VACUUM BOX FOR USE IN HIGH SPEED PAPERMAKING

[75] Inventor: Keith V. Thomas, Tacoma, Wash.

[73] Assignee: Weyerhaeuser Company, Tacoma, Wash.

[21] Appl. No.: 235,313

[22] Filed: Feb. 17, 1981

Related U.S. Application Data

[63] Continuation-in-part of Ser. No. 91,211, Nov. 5, 1979, abandoned.

[51] Int. Cl.[3] ..... F26B 13/08

[52] U.S. Cl. ..... 34/114; 34/116; 34/117

[58] Field of Search ..... 34/15, 16, 41, 54, 114, 34/115, 116, 117, 122, 123

[56] References Cited

U.S. PATENT DOCUMENTS 3,874,997 4/1975 Kankaanpaa ..... 34/115

4,202,113 5/1980 Kankaanpaa ..... 34/114

OTHER PUBLICATIONS

Article by D. A. Ely, "A Look At Papermaking Concepts For The Future", Paper Age, Apr., 1981, pp. 38–40+2 pp. drawings.

*Primary Examiner*—Larry I. Schwartz

[57] ABSTRACT

An improved vacuum box is described for holding a paper web onto a supporting fabric wherever velocity stresses would otherwise separate the web from its supporting fabric and expose the web to those stresses. Specially shaped vacuum boxes are fitted into the dryer "pockets" formed between the rows of a double row of adjacent drying cylinders and the web traveling a serpentine path between them. Pressure differential zones of the box hold the web onto its supporting fabric as the web and fabric travel between heated drying cylinders. A first zone leads the departure of the web and fabric from the web-wrapped cylinder to ensure that the web is positively held to the fabric as it leaves the cylinder. A second arcuate suction zone adjacent a fabric-wrapped cylinder evacuates grooves in the adjacent cylinder. This system holds the web onto its fabric, overcoming centrifugal stresses on the web, as the web-fabric combination passes about a cylinder with the fabric in direct contact with the cylinder and the web in indirect contact. A third pressure differential zone ensures the web is held to its supporting fabric as it travels from the fabric-wrapped cylinder to the next web-wrapped cylinder in the drying sequence. The vacuum box is provided with seals between box surfaces and the fabric that reduce air leakage into the box yet accommodate waste paper passing between the drying cylinder surfaces and box surfaces without damage to the box or fabric. Box end seals perform a similar function. The end seal is provided with a spring and pivot arrangement which cooperate to accommodate waste. The top portion of the vacuum box is a curved surface designed to deflect at least a portion of the stray currents that typically flow in the dryer pockets and tend to lift the web from its supporting fabric. While the suction surface zones are generally open surfaces, a roller wearing surface may be provided which reduces the wear of the felt in passing through the vacuum box suction zones. The vacuum box may be compartmentalized across the width of the machine to permit reducing vacuum demand during start-up of the paper web through the machine.

11 Claims, 11 Drawing Figures

VACUUM BOX FOR USE IN HIGH SPEED PAPERMAKING

This is a continuation-in-part of application Ser. No. 091,211, filed Nov. 5, 1979, now abandoned.

BACKGROUND OF THE INVENTION

1. Field of the Invention

This invention relates to paper machine productivity and means for attaining machine speeds significantly in excess of the prior art. The invention is concerned with eliminating stresses that act on the wet paper sheet as the web travels through the drying portions of the paper machine.

2. Prior Art

In papermaking, after sheet formation, the paper web, supported on one of a series of porous felts, passes through a series of press nips that mechanically express water from the sheet. The wet web at about 35–45% fiber content is then contacted with a series of heated drums or cylinders that evaporate water from the web to a finished dryness of about 90–95%. The web is, conventionally, unsupported at many points in the process as it travels between the later press nips and between the heated drums in the dryer section.

Machines that are not forming or drying limited are run at increasing speeds to gain production. A practical limit is always reached where increased productivity expected by further increases in speed is nullified by increased production losses due to sheet breakages and product defects. For example, newsprint machines appear to be limited to about 3,500 ft./min. (1070 m/min.) by current technology. This practical machine speed limit differs for each paper grade such as newsprint, liner, medium or fine paper. Further, within each grade of paper, the speed limit differs for differing basis weights.

Observations of operating paper machines show that, as speed increases, breaks in the web generally occur at those points in the process where the web is: (a) transported unsupported through the process while relatively wet and weak, such as occurs in transferring the web from the press to the drying section and between drying section rolls or cylinders, or; (b) required to change direction quickly while in adhesive attachment to a supporting element, such as occurs when the web is picked up by a felt from the forming wire.

When the speed of the machine is held constant, breakages increase with decreased paper basis weights within each grade. These breakages occur where the web is transferred from one machine element to another by pulling or peeling the web from the element to which it is adhered, such as occurs at transfers from forming wires to press felts and from press rolls to dryer sections.

For further discussion regarding drying section and press section stresses, see U.S. patent applications Ser. No. 091,684 filed Nov. 5, 1979 abandoned, now continuation-in-part, Ser. No. 234,288 and Ser. No. 091,212 filed Nov. 5, 1979 now continuation-in-part Ser. No. 252,969 respectively, both by Keith Thomas of Weyerhaeuser Company, incorporated herein by reference.

Edge "flutter" in the dryer section may also be observed. Flutter tends to cause edge "stretch," resulting in wrinkling defects in the finished product. Differential stretching at the web edges also imparts instability or "curl" to the finished paper.

It is well known that, as a paper web passes through the dewatering and drying process on the paper machine, it, in general, gradually develops strength with increased dryness. Practicalities determine that the overall speed of the paper machine be limited to make sure that stresses in the web do not approach, at any point, too closely to the paper web's breaking strength. Without a more detailed knowledge of the strength of the web and the stresses operating on it as it passes through the machine, papermakers have in the past attempted to avoid in an empirical way the increased sheet breakages observed with increased speed and decreasing paper weights.

These efforts include press and dryer section designs where the wet web travels with a porous felt or fabric during transit through at least a portion of either section.

Mahoney, in U.S. Pat. No. 3,503,139, provides a fabric intended to support the wet sheet throughout its serpentine travel from drum to drum in the dryer section. What actually happens as machine speeds increase is that the web is lifted and separated from its supporting fabric, particularly at points where the web approaches and departs drying cylinders. The lifting forces are centrifugal forces exerted on the web at certain locations in the machine and air currents caused by the turning drums and moving belts in the dryer section. These forces are generally non-critical in conventional systems only because these systems operate at low speeds. At higher machine speeds, however, these stresses increase in magnitude to cause breakages. Whenever the web is lifted from its supporting fabric, it is subjected to velocity stresses as if the fabric were not present.

It should be noted that the Mahoney web, as is typical of the prior art, is totally unsupported at the transfer from the press section to the first dryer cylinder. Thus, at this transfer, in addition to peeling stresses, the web is also subject to the velocity-related stresses noted.

In Mahoney, the web is, alternatively, partially wrapped in direct contact with one drum followed by indirect contact with the next drum. Mahoney compensates for the loss in heating effectiveness occasioned by the indirect contact of the web with the heated drum surfaces on alternate drums by operating those drums at higher temperatures.

In an improvement over Mahoney, Soininen et al., in U.S. Pat. No. 3,868,780, adds a number of rolls to the Mahoney system to guide the web into direct contact with each of the heated drums during transit of the web through the dryer section. In recognition of the increased likelihood of "flutter" separating the web from its support on the longer runs between dryer drums, the Soininen guide rolls operate under vacuum that adheres the web to their supporting surfaces. There is also an overall vacuum system to help hold the web onto supporting fabrics.

The Soininen system has a number of operating impracticalities. The guide rolls tend to cause a relatively large differential movement between the tender web and the fabric, resulting in "scuffing" damage to the web. The complexity of the system and extra components required introduce substantial capital costs. Operating costs are high because of the power required to drive the extra components and also since cleanout of paper after breakages appears to be difficult. Heat applied to only one side of the sheet, as in Soininen, results in paper products having different characteristics for each surface. These differences can cause printing non-uniformities when both sides must be printed.

In sum, the prior attempts to improve paper machine productivity by increasing machine speeds have generally failed because their designers have, up until now, had only an imperfect understanding of where in the papermaking process stresses operating on the moving sheet become critical and limit speed. Also lacking has been an understanding of how paper machine conditions, such as those affecting sheet temperature, for example, affect the ability of the sheet to resist velocity stresses.

SUMMARY OF THE INVENTION

A principal object of this invention is to reduce and, to the extent possible, eliminate those stresses ordinarily operating on the wet web in and near the drying section of the paper machine that are a function of velocity of the sheet and which limit machine speed. These stresses limit production speeds because of the threat of down-time occasioned by sheet breakages and product quality defects which papermakers expect as speed is increased.

This invention requires holding the paper web to a supporting drying fabric by employing pressure differential means that, acting normal to the web, force the web onto its fabric. The pressure differential means are necessary wherever in the paper making process the permeability of the fabric and the moisture content of the web combine so that velocity stresses would otherwise cause the web to separate from its supporting fabric and be subjected to the speed limiting stresses of unsupported webs.

The pressure differential generating means for holding the paper web positively onto its supporting fabric, for transport through the dryer section, is preferably a specially shaped vacuum box. The vacuum box substantially fills the typical "pocket" formed in double row drying cylinders arrangements. The pocket is the space between the rows and the web-fabric combination traveling in a serpentine path from row to row.

The essential features of the vacuum box holding means of the invention are: (1) a number of pressure differential zones to hold the web onto its supporting drying fabric at all times during drying where the web is not self-supporting; (2) sealing means; (3) and a means for generating the necessary pressure differential holding force.

An initial pressure differential zone is adjacent the fabric traveling between a web-wrapped and a fabric-wrapped cylinder with the zone sufficiently leading departure of the web-fabric combination from said web-wrapped cylinder in order to capture and hold the web to the fabric at departure of the web from the cylinder.

A second pressure differential zone is adjacent the portion of the surface of the fabric-wrapped cylinder not wrapped by the fabric means. The fabric and cylinder major surfaces in combination define, on the portion of the cylinder wrapped by the fabric, a plurality of circumferential grooves about the surface area contacted by the cylinder-wrapping fabric.

A third pressure differential zone is adjacent the fabric traveling between the fabric-wrapped cylinder and a next web-wrapped dryer cylinder.

Seal means further define each pressure differential zone between the zone and the fabric means. The seals limit air leakage into the zone while permitting the passage of waste paper between vacuum box fixed surfaces and the drying cylinders.

A means for causing a pressure differential force in the zones is provided to assert, through the fabric, holding forces on the web where the web is adjacent the fabric, and indirect holding forces, acting through the drying cylinder grooves, on the web as it travels about the fabric-wrapped cylinder, to hold the web onto the fabric.

The combination of fabric and cylinder surfaces defining the plurality of circumferential grooves about the surface area of the fabric-wrapped cylinder through which the second zone operates may consist of a conventional dryer fabric and circumferential grooves cut into the cylinder surface. Alternatively, the circumferential grooves may comprise a fabric having longitudinal ridges formed in the surface of the fabric that bears against the surface of the cylinder.

A preferred vacuum box comprises a fixed surface means, extending between adjacent web-wrapped cylinders, for deflecting machinery-generated air currents from impinging upon the web supported upon its dryer fabric. The surface extends across the width of the paper machine between the adjacent web-wrapped cylinders. The leading edge of the surface with respect to the machine direction leads the line of departure of the web and fabric from the web-wrapped cylinder while the trailing edge of the surface extends at least until the web and fabric contact the subsequent web-wrapped cylinder. The vacuum box is fitted with end wall means to limit air flowing into the ends of the vacuum box pressure differential zones. One edge of the end surface means is coincident with the outer machine direction edges of the air deflecting, fixed surface means. An opposite edge extends closely adjacent the fabric-wrapped cylinder. The edges adjacent the web-supporting fabric traveling between the web- and fabric-wrapped cylinders extend close to the fabric but are sufficiently distant from the fabric so that paper waste passing between the cylinders and the edges cannot cause the fabric to contact the edges. Sealing means are provided between the vacuum box surface means and the fabric means to limit air leakage into the box while permitting the passage of waste paper wads between the surfaces and drying cylinders without damaging the box surfaces, fabric or sealing means. A means of evacuating the box is provided to establish sufficient pressure differential to hold the web onto its supporting fabric.

The sealing means comprises seals that approach as close as practical the fabric across the width of the paper machine. These seals must be flexible and resilient and approach the fabric perpendicular to the surface of the fabric. The seals always approach the fabric opposite a solid cylinder surface so that air currents traveling with the moving web and fabric cannot, impinging upon the seals, penetrate the porous dryer fabric and initiate separation of the web from its supporting fabric. Each seal is of sufficient dimension to accommodate paper waste passing between the box surfaces, fabric and the cylinder surface by flexing in response to such passage and returning to its sealing position after the waste has passed by the seal. The vacuum box is also provided with end seal means for sealing between the fabric and the end surface means. These seals have leading edges substantially conforming to the path travelled by the fabric supporting the paper web as the fabric travels from a web-wrapped cylinder to a fabric-wrapped cylinder. The trailing edges of the seals overlap the end surfaces. Each end seal means is pivotally mounted on the end surface means or some other convenient supporting means near the fabric-wrapped cylinder. A spring means, likewise conveniently mounted, near the web-wrapped cylinder, urges the seal leading edge as close as practical, consistent with limiting fabric wear, to the fabric. The pivot and spring interact to permit passage of waste paper between the web-wrapped cylinder and the vacuum box end seals without damage to the vacuum box, seals or fabric.

The vacuum box may be provided with internal wall means for separating a pressure differential zone from adjacent zones so that such separated zones may be operated at different pressures. The pressure zones may communicate with each other through an orifice provided with an adjustable plate wherein the pressure differential means may operate directly on the zone requiring the highest vacuum level to accomplish the function of holding the web onto its supporting fabric. The pressure regulating means between the zones are adjusted so that the high pressure differential causes sufficient pressure differential force levels to be exerted in the remaining pressure differential zones by leakage through the apertures to permit those zones to accomplish their web-holding functions.

The top surface of the vacuum box may be concave in order to deflect at least a portion of the machinery-generated stray air currents from the pocket area of the dryer.

In another arrangement a concave, contoured top surface of the vacuum box, located substantially between adjacent web-wrapped cylinders opposite the zone adjacent the fabric-wrapped cylinder, is provided with an aperture. A second concave surface is positioned adjacent the top surface. The two surfaces together create a venturi throat at the aperture. Stray air currents generated by the moving fabrics and cylinders pass through the venturi to provide pressure differential forces in the vacuum box sufficient to hold the web to its web-supporting fabric at the pressure differential zones.

In another embodiment, suitable for lower speeds, the vacuum box means is provided with roller surfaces for supporting the fabric as it travels between a web-wrapped cylinder and a fabric-wrapped cylinder. A framework defining the pressure differential zone between the web-wrapped cylinder and the fabric-wrapped cylinder is supported in the pocket area. Roller surfaces are mounted on this framework, which surfaces are free to rotate at the speed of the traveling fabric. The framework is pivoted near the fabric-wrapped cylinder so that it may pivot away from the web-wrapped cylinder to accommodate the passage of waste paper between the cylinder and the vacuum box surfaces. A spring means urges the roller surfaces into contact with the fabric, thereby providing support for the fabric while minimizing friction between the fabric and vacuum box surface means.

The suction box may be divided into separately valved compartments so that a portion of the box may be closed off during machine start-ups, reducing power demand.

DESCRIPTION OF THE PREFERRED EMBODIMENTS

1. Inherent Strength of the Paper Web

Paper web strength, first of all, is a function of the paper furnish being processed. This property is a function of the species of wood making up the fibers. For example, papers made of softwood fibers, such as Douglas fir, are stronger than paper made of hardwood fibers, such as alder. Strength is also a function of the pulping process used in separating the fibers from the wood raw material. For identical wood species, groundwood, for example, is known to have an appreciably lower strength at a given moisture content than chemical pulps made by the sulfite or kraft process.

For any pulp furnish, the strength of a paper sheet is primarily a function of its moisture content. Lyne and Gallay, "Measurement of Wet Web Strength" Tappi Vol. 37, No. 12, (December 1954). The ability of a paper web to resist stresses without breaking at any point in the papermaking process is, therefore, principally related to its moisture content.

In general, the moisture content of the paper web decreases as it passes through the papermaking process, with the strength of the paper web increasing as the web increases in dryness. However, there is a marked interruption in strength gain as the web is passing through the early drum drying stages.

Strength actually decreases on the first few dryer drums, after transfer from the last press nip, as the web experiences a rapid increase in temperature. At this stage, the temperature of the web is approaching the boiling point of the moisture present.

This not previously recognized and quantified strength reduction is a temperature phenomenon. The phenomenon has remained obscured perhaps because strength testing, including the work conducted by Lyne and Gallay cited above, has been done at 70° F. (21.1° C.) as a matter of standardized testing procedure to permit comparisons between pulps. The temperature effect on testing has thus been known but the significance of the degree to which the actual strength of the sheet in the process is effected by processing temperature has escaped the attention of papermakers.

Figure 1:
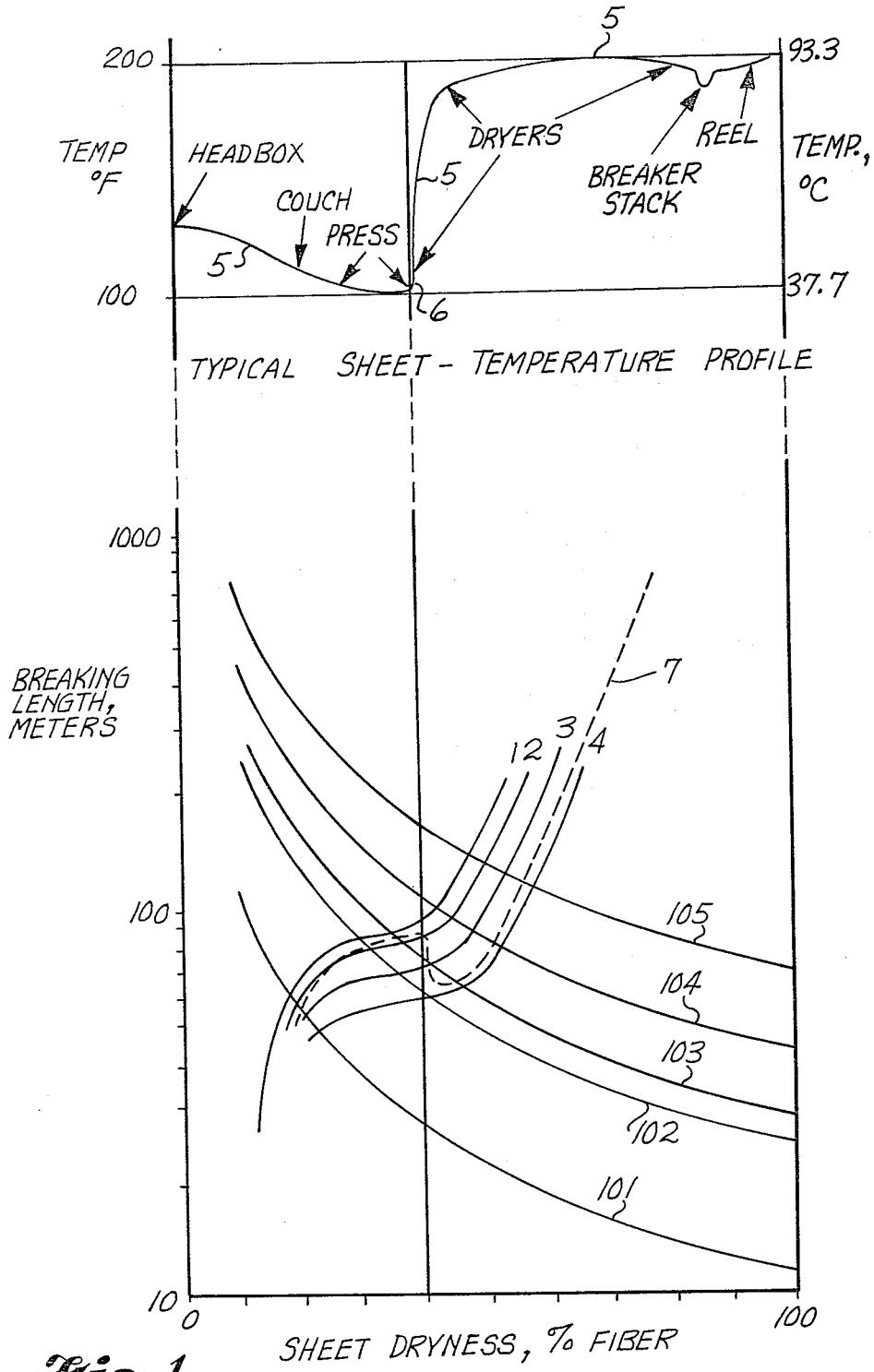
FIG. 1 illustrates paper web strength as a function of sheet dryness, temperature of the web as the web progresses through the paper machine, and stress on the web as a function of velocity.

Referring to FIG. 1, the significant decrease in sheet strength resulting from increasing temperature for a typical newsprint furnish is shown. The family of curves 1, 2, 3 and 4 shows the temperature effect on strength for a newsprint furnish. The curves are for 70°, 100°, 150° and 200° F. (21.1°, 37.7°, 65.6° and 93.3° C.), respectively. The data used in plotting FIG. 1 were derived from samples of a newsprint furnish, comprising a combination of groundwood and chemical pulp.

In FIG. 1, paper web strength, in terms of "breaking length" is shown as a function of "sheet dryness", in weight percent fiber. Breaking length, expressed in meters, is the length of a strip of paper which would break of its own weight if suspended vertically. Breaking length is related to tensile strength which is the force, parallel with the plane of the paper, required to produce failure of a specimen of specified width and length under specified conditions of loading.

Curve 5 shows sheet temperature as the sheet proceeds through the papermaking process on a typical machine. The temperature of the sheet decreases slightly from the head box through the last press nip, indicated at point 6, on curve 5. As the web contacts the first few dryer drums, the temperature rises extremely rapidly. Thereafter the temperature remains relatively constant as drying continues.

The strength of the newsprint paper sheet as it passes through the machine is shown by dashed curve 7. There is an increase in strength initially as the sheet is dewatered on the forming wire. There is a relatively lower rate of increase through the press section. A substantial decrease in strength follows as the web contacts the first several drum dryers where the water and web are heated with little change in dryness. While some water is driven off, the drying effect is more than offset by a decrease in web strength due to the temperature effect, previously demonstrated by curves 1–4, resulting in a significant net decrease in strength. Thus the discontinuity in increasing strength as the sheet increases in dryness, at the first few drums in the dryer section, is the result of the sudden increase in temperature of the web.

Curve 7 of FIG. 1, a composite of the strength curves 1-4 and process temperature curve 5, shows the strength of the sheet of the particular newsprint furnish examined as a function of dryness and temperature, as it travels through the papermaking process. If velocity stresses or other stresses exceed the strength of the sheet, related to the dryness, temperature and paper furnish, sheet breakage will occur.

2. Identification and Elimination of Productivity Limiting Stresses

Prior art paper machine operating speeds are limited or bottlenecked by web breakages of the weak, wet fiber web. As previously noted, the critical stress points in the process, observed most frequently, are:

(a) where the web experiences large angular changes;

(b) where the web is allowed to run unsupported and is thus subjected to velocity stresses; and (c) where the web is pulled or peeled from a machine element to which the web is adhered, e.g., a press roll.

The relationship between velocity and the ability of a web, made of a given material, to survive without breaking, as the machine speed is increased can be analyzed mathematically. The quantified results are confirmed by actual observations of the critical locations in the process.

Inspection of the paper sheet as it passes unsupported through the conventional paper machine shows that the paper web does not travel without a certain amount of slack building up in the web, particularly as it travels between drying cylinders. This is so because only a limited tension can be exerted on a relatively weak paper web in pulling or "drawing" it through the process without causing a breakage. Bulges and series of standing waves tend to build up in the slack web, their form or frequency dependent upon sheet velocity, the distance of the web travels unsupported, and air currents generated by operating machinery.

The forces exerted on the web as it moves through a standing wave, as described above, or about a roll may be viewed in terms of conventional centrifugal force analysis. The minimum loads or stresses parallel with the plane of the paper that a fiber paper web experiences as it travels through the machine can then be calculated in terms of tensile stress.

For an element of a dry paper web, the tensile stress due to the centrifugal forces exerted on the web as it passes through, for example, a standing wave, generally circular or sinusoidal in profile, may be expressed as:

$$T_s = \frac{\sigma v^2}{g}$$

where $T_s$=tensile stress=the tensile force in the sheet resisting centrifugal forces acting on the element per unit thickness of the sheet, v=linear speed of the sheet, g=gravitational acceleration, and $\sigma$=density of the sheet=basis weight÷thickness of the sheet, wherein basis weight is the weight of fiber in a standard area of paper. The tensile stress, $T_s$, can be expressed in terms of "equivalent breaking length" ($EBL_v$) as follows:

$$T_s = EBL_v \times \sigma$$

$$\therefore EBL_v = \frac{v^2}{g}$$

This expression is based on dry density. For wet webs, a dryness factor, $$d = \frac{100}{\%\ \text{dryness}},$$

must be introduced.

Thus $$EBL_v = \frac{v^2}{gd}$$

This analysis shows that web stresses $T_s$ and $EBL_v$ are independent of the radius traveled by the sheet, its basis weight and its dry density. These stresses are inversely proportional to sheet dryness and constant for any velocity and dryness.

Referring to FIG. 1, curves 101, 102, 103, 104 and 105 show velocity stress expressed as equivalent breaking lengths versus dryness for machine speeds of 2,000, 3,000, 3,300, 4,000 and 5,000 ft./min. (610, 915, 1006, 1220 and 1525 m/min.), respectively. The curves show the minimum strength the web must have in order to travel unsupported at the selected speed.

These calculated stresses are minimum stress loads because generally there are additional stresses caused by local flapping or fluttering, both longitudinal and cross machine, particularly at the edges of the web. Air currents, generated by the rapidly turning rolls, fabrics and other machinery, typically cause these stresses on the moving sheet.

Stresses calculated by the above analysis are valid even for those cases where prior workers have attempted to support the paper web on a fabric or felt as, for example, Mahoney, cited above. This is so because air currents tend to penetrate a porous fabric and "bulge" or lift the paper sheet from its supporting contact with the fabric. These bulges cause the web to be subjected to the above-described velocity stresses. Also, on those drying cylinders where the fabric directly wraps the drum with the web on the outside, the web tends to separate from the fabric under the centrifugal stresses resulting from passing about the rotating roll. In situations such as Soininen, et al, cited above, the web leaving the last press nip adheres to the solid press roll and must be peeled therefrom. In the gap between the surface of the press roll and initial contact with a supporting fabric, this web is unsupported and thus subjected to web breaking velocity stresses.

A conclusion to be drawn from the analysis of the velocity stresses acting on the web is: the wet web must be transported on a supporting means wherever it would be, if not supported, subjected to speed related stresses that are likely to exceed the breaking strength of the web, if production machine speeds are to be increased beyond conventional levels. FIG. 1 indicates, for a particular paper, that the web must be supported whenever "breaking length" stresses, for example, the velocity stress levels indicated by curves 101, 102, 103, 104 or 105, are above strength curve 7 levels at any point in the process.

Analysis of the failures of past attempts at supporting the web leads to a further conclusion that a means must be provided to ensure that the paper web is held onto its supporting means, in order for the web to remain independent of the velocity forces that tend to act on the separated web. Failure to recognize this need for a means to hold the web onto its supporting fabric characterizes, in general, the prior art designs.

It has long been the experience of papermakers that the productivity of a paper machine is reduced when there is a significant reduction in the basis weight of the grade being manufactured. This production rate penalty is accepted because lightweight papers often command a price premium in the market. Machines making lightweight paper grades are conventionally of the type that utilizes a single felt in the last press nip, pressing the web against a smooth hard-surfaced roll. The sheet adheres to these rolls requiring a peeling or tensile stress to be exerted on the web to pull the web free of the roll surface.

The forces in the sheet required to pull it from a press roll have been defined by Mardon and others. See Mardon, "The Release of Wet Paper Webs from Various Papermaking Surfaces," APPITA Vol. 15, No. 1 (July 1961). These peeling stresses are the primary speed-limiting factor in conventional paper machines when basis weights are reduced, aside from velocity stress considerations. The peeling force per inch of width required to remove the web from a smooth press roll is independent of the sheet weight. However, reducing the basis weight by reducing the thickness of the sheet increases the peeling stress experienced by the sheet. If the basis weight is reduced by one-half, the stress exerted in the web is doubled. Peeling stresses are discussed in more detail in the above-identified concurrently filed U.S. application, Ser. No. 091,212, now abandoned.

Other factors affect the operating speed of a given machine, including limitations imposed by forming, pressing, drying and sheet treatments such as coating, sizing, calendering and the like. Factors other than those imposing stresses on the sheet during pressing and drying are outside the scope of the invention and, for discussion, are assumed to be met by the strength of the sheet. In order words, the prior art machine is speed limited by the velocity stresses imposed on the sheet where it is unsupported in the press and dryer sections.

3. Detailed Description of the Invention

The above analysis clarifies the velocity stress, peeling stress and basis weight interactions which place speed and paper furnish restrictions on the prior art processes and machines. Generally, the velocity stresses are speed limiting for heavier weight sheets. These stresses have been shown earlier to be independent of basis weight. As basis weight is reduced, peeling stress increases until it become the predominant speed limiting factor.

The elements of this invention eliminate velocity stresses which currently limit machine speeds and productivity by holding the paper web positively on its supporting means.

The holding means of this invention is preferably a vacuum box that creates pressure differential forces that, acting through the fabric perpendicular to the adjacent web, causes the relatively impervious wet web to adhere to its supporting fabric. A vacuum box is provided wherever the web-fabric combination would otherwise be exposed to paper machine velocity stresses and particularly where velocity stresses would otherwise tend to separate the web from supporting contact with its fabric. A major advantage of the present invention is that since the papermaking process is made independent of velocity stresses the machine may be run at speeds limited only by drying rates.

Figure 2:
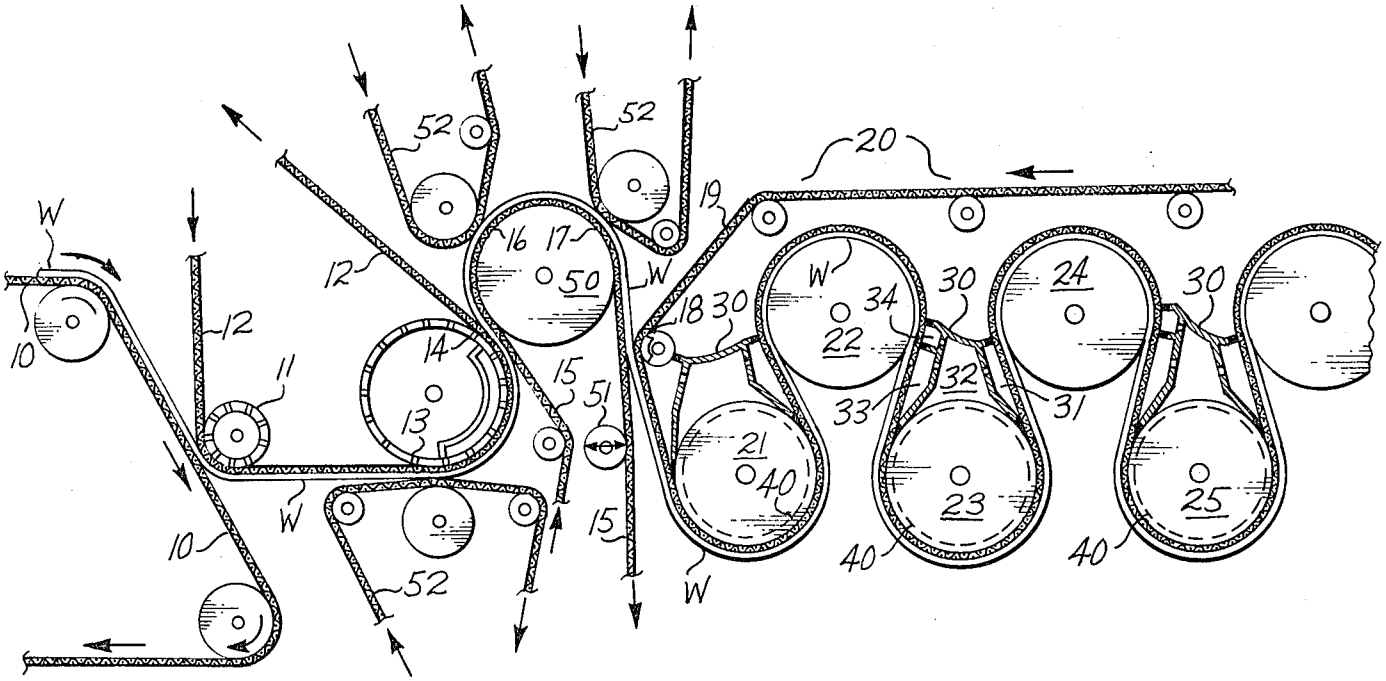
FIG. 2 is a schematic elevation view of a paper machine, including a vacuum box of this invention.

Referring now to FIG. 2, a preferred embodiment 30 of the invention is shown in a typical paper machine arrangement. Paper web W is formed on wire 10. Pickup roll 11 transfers the web onto press felt 12. The web W progresses, supported on the felt 12, through the first two press nips 13, 14. The web W is transferred to a belt 15 at the nip 14 for subsequent travel about press roll 50 through the first two nips 16, 17 of the press section. Felts 52 carry away water absorbed from the web at nips 13, 16, 17. After the last pressing nip 17, transfer roll 18, with directional roll 51 in cooperation, effects a transfer of the web W from belt 15 onto dryer fabric 19 for transport through dryer section 20.

The web travels on fabric 19 thereafter in a serpentine path through the dryer section 20 about each of the dryer drums successively. The web is in indirect wrapping contact with the initial drum 21, with the fabric in direct contact with the heated surface of the drum. The web is then transported into direct heat transfer contact with the upper drum 22. Thereafter the web is transported into indirect or direct contact with the cylinders in sequence through the dryer system.

The characteristics of the web and machine conditions determine what holding forces adhere the web to its supporting means during transit through the machine. The sheet leaving the forming wire 10 is wet and adheres to the pickup press felt 12 and press belt 15. Adherence of the web to press belt 15, independent of velocity stresses, depends upon belt characteristics such as low permeability and porosity, more fully discussed in the above-identified concurrently filed applications. The sheet after the press section will not in general adhere to the typical dryer fabric 19; in part, because the sheet, in passing through the dryer, becomes drier and more permeable, and; in part, because the dryer fabric 19 is much more permeable than press felts 12 and press belt 15. Adherence forces, dependent upon surface tension forces between the web and a fabric become weaker and eventually ineffective as the web and fabric become drier and more permeable.

Referring to FIGS. 2–6, a preferred means of this invention for applying pressure differential holding forces to the web to positively hold it to its supporting fabric 19 comprises a contoured vacuum box 30 (vacuum source not shown). The vacuum box 30, in general, fills dryer section "pockets" existing between cylinder rows and the traveling fabric 19. A vacuum box 30 is positioned adjacent to each drum 21, 23, 25, etc., in the dryer drum section 20 where the fabric 19 wraps the drum surface directly with the web traveling on the fabric about the drum. A vacuum box between the pickup vacuum roll 18 which removes the web from press belt 15 and the first drying cylinder 21 will generally be necessary, depending upon actual physical layout of the drying section. None is required here because the first vacuum box 30 has been extended to bear upon tranfer roll 18 to exert holding forces on the web.

The suction box 30 is provided with four pressure differential surface zones or suction surfaces 31, 32, 33 and 34. Three of the suction zones 31, 33 and 34 are adjacent the web-supporting fabric 19 as the fabric travels to and from a fabric-wrapped cylinder, for example, cylinder 23 of FIGS. 2 and 3. These suction zones 31, 33 and 34 extend, at least in effect, to create a pressure differential force acting through the fabric 19 to hold the relatively impervious wet web W to the fabric surface, independent of any velocity stresses such as stray air currents or centrifugal forces.

Figure 3:
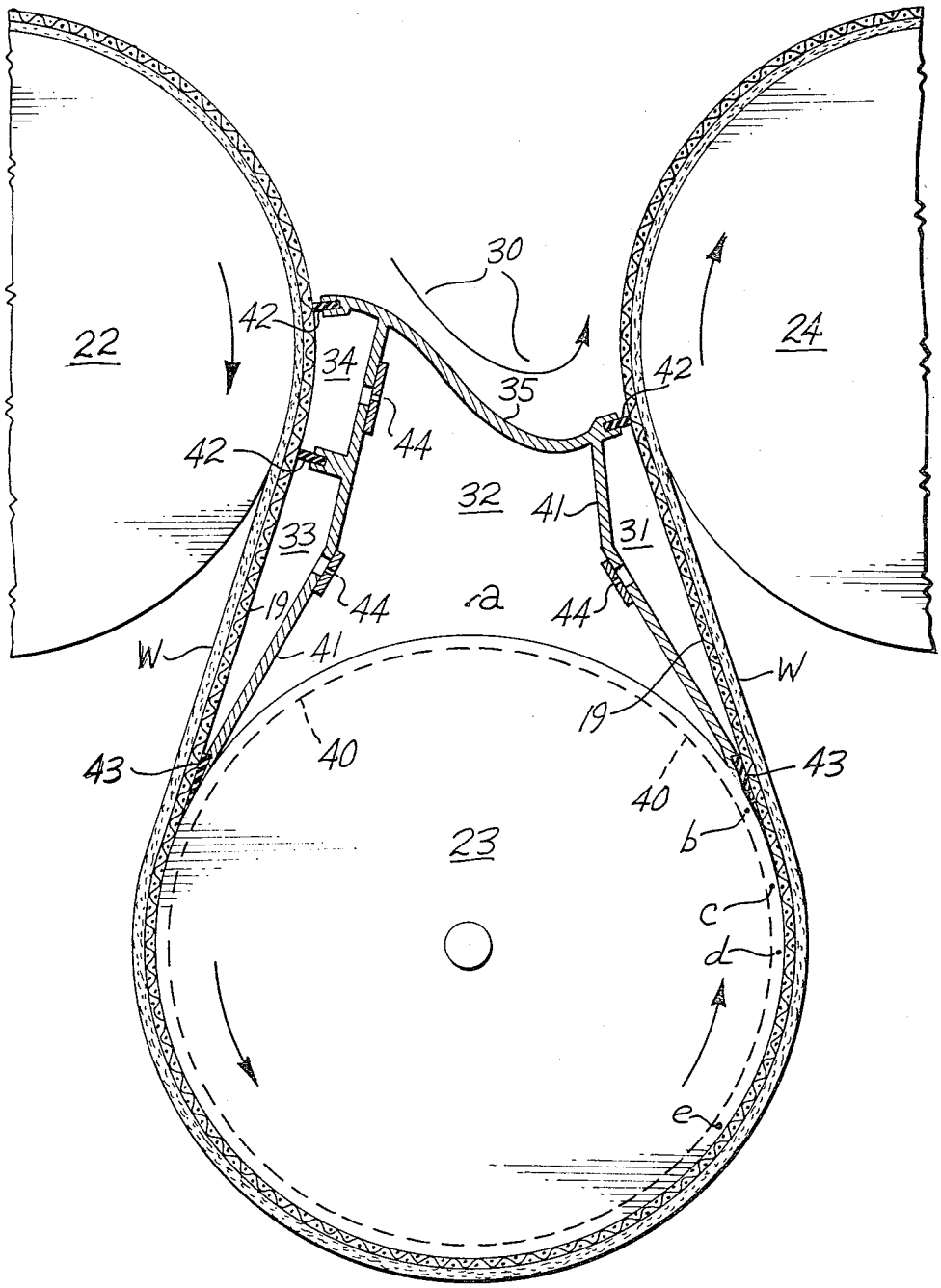
FIG. 3 is a schematic detailed view of the vacuum box of this invention associated with drying cylinders.

Referring to FIGS. 2 and 3, the suction zone 32, adjacent the portion of the drum 23 not wrapped by the fabric 19 ensures that a pressure differential force holds the fabric 19 and web W to the surface of the drum 23, overcoming centrifugal stresses that are exerted on the web as it travels about the drum.

In a preferred embodiment, each bottom cylinder 21, 23, 25 is provided with a plurality of shallow circumferential grooves cut into the cylinder's outer surface, spaced across the face or length of the drum. These grooves 40 are indicated at the periphery of each lower drum 21, 23, 25. The resulting pressure differential induced in the drum grooves 40 by suction zone 32 holds the fabric-web combination in supporting contact with the drum surface.

Referring to FIG. 3, in a preferred embodiment of the invention, it is desirable to divide the vacuum box 30 internally into relatively high and low pressure differential zones depending upon what forces must be exerted on the web to hold it to its supporting fabric 19. FIG. 3 shows the vacuum box divided into four zones by walls 41 and seals 42, 43. Vacuum zone 32 must operate at a relatively high vacuum in order to hold the web and fabric to the dryer drum 23 as they are subjected to centrifugal stresses during travel about the drum. Vacuum zone 34 must also operate at a relatively high vacuum in order for the zone forces to capture and to hold the web onto the supporting fabric as it departs direct contact with the dryer drum 22. Zones 31 and 33 may be operated at significantly lower vacuum values as they need only keep the web adhered to the fabric as it travels between the dryer drums where otherwise the web would be subjected to speed limiting stray air currents and minor centrifugal forces.

In the preferred vacuum box 30, the divider walls 41 are apertured with adjustable orifices 44 which permit communication between vacuum zones 31, 32, 33 and 34. The orifices 44 are typically adjusted so that evacuating zones 32 and 34 to create a high vacuum in those zones causes evacuation of zones 31 and 33 at a lower rate. As a result, zones 31 and 33 operate at lower relative vacuum than zones 32 and 34, but sufficient to ensure that the web is held to supporting fabric 19 opposite zones 31 and 33.

The vacuum box suction zones are designed to effectively provide sufficient pressure differential forces acting perpendicular to the major surface of the web to ensure that the web is held onto its supporting fabric 19 regardless of machine environmental conditions, web characteristics or specific fabric or machinery factors which would otherwise operate to cause the web to separate from its supporting fabric. These factors, of course, influence the exact operational shape of box 30. It was discovered experimentally that vacuum zone 34, which initially operates on the web as it leaves direct contact with dryer drum 22 must exert its pressure differential forces on the web-fabric combination significantly prior to the expected line of departure of the web-fabric combination from the drum 22. The zone 34 must operate on the web and fabric sufficiently in advance of the tangent line of departure in order to have sufficient time for the vacuum to remove air from the dryer fabric and establish forces sufficient to hold the web to the fabric.

As a practical matter, a doctor blade may be provided to ensure complete removal of the web from web wrapped cylinders 22, 24, etc. In general, however, the web will travel with the fabric at departure from the web wrapped cylinder as there is a layer of vapor between the hot cylinder surface and the web which prevents the web from adhering to the cylinder surface. This is a very different condition from that existing at the smooth press roll where the web is pressed into adherence with the roll surface and must subsequently be peeled from that surface at departure.

The vacuum zone 31 need only operate at the line of departure of the web from the drum 23 up to direct contact of the web with the next drying drum 24.

A key practical feature of the vacuum box 30 of this invention is that contact between the rapidly moving fabric supporting means and other machine elements is minimized. Fabric wear and damage will inherently occur whenever the web comes into contact with a stationary, rigid surface. The most significant damaging conditions occur in typical paper mill arrangements when a wad of paper comes between a fabric and the dryer drum and the resulting bulge contacts a rigid machinery surface. Such contact can destroy the fabric and, of course, cause a machine shut-down.

Figure 4:
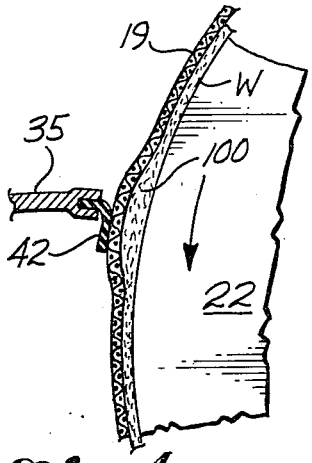
FIG. 4 is a detail view showing a vacuum box flexible fabric seal deflected by a paper wad.

As a solution to this problem the vacuum box 30 is provided with flexible seals 42 extending across the width of the machine. The seals are made of any resilient flexible material that will cause minimal damage to the fabric if the fabric, traveling at high dspeed, inadvertently contacts a seal. The seals extend perpendicular to the fabric surface as close as practical to the surface of the fabric without bearing against it. FIG. 4 shows seal 42 bending as a paper wad 100 bulges out fabric 19 in passing about the drum surface 22.

The seals 42 must approach the fabric where the fabric-web combination is in contact with a solid surface, such as a dryer cylinder. Otherwise, air currents traveling with a moving fabric or roll will impinge upon the seal, penetrate the fabric, and lift the web from its supporting means exposing it to velocity stresses.

Seals 43 may be made of more rigid materials since there is no wad damage problem. These seals 43 bear directly on the surface of the drum 23.

Figure 5:
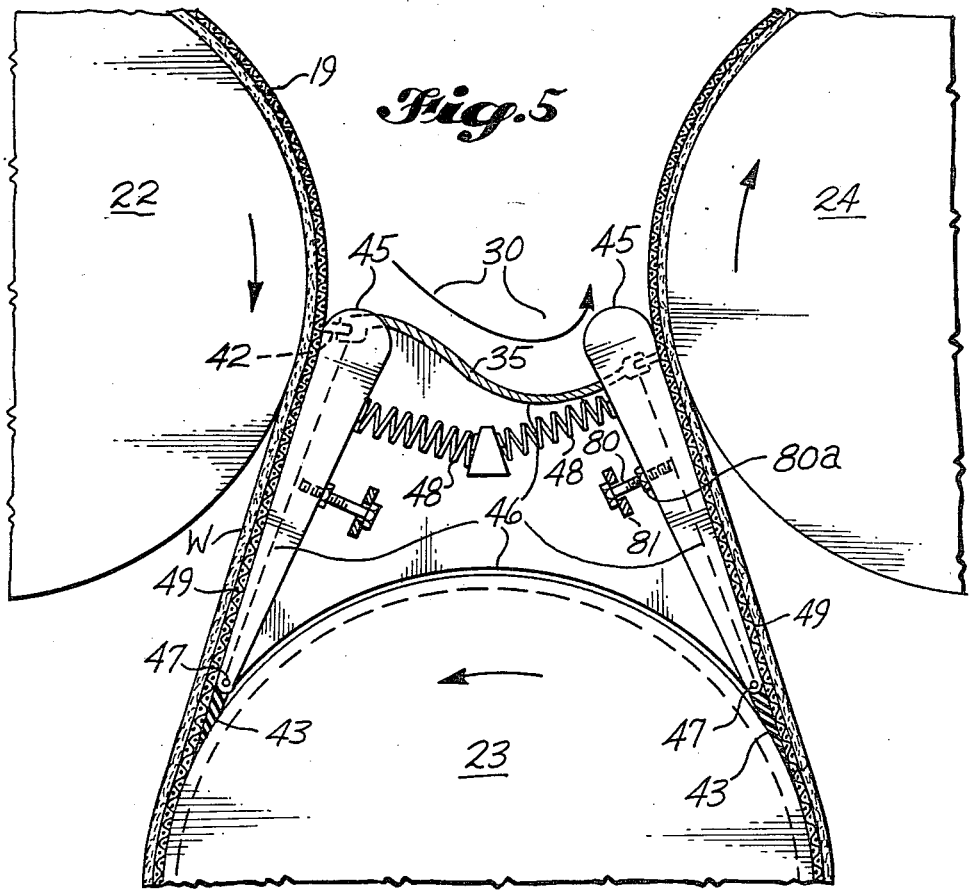
FIG. 5 shows box end seals installed on the vacuum box of this invention.

End seals for the vacuum box 30 are shown in FIG. 5. The function of these seals is to preserve the vacuum in the box 30 while accommodating the passage of wads of paper through the system without damage to the fabric or box. The end wall 46 of the vacuum box is dimensioned to conform closely to the adjacent drum 23 where there is no danger of paper waste blockages. The portions of the end wall 46 adjacent the traveling fabric 19 are fitted to allow a generous space between its edges and the traveling fabric to accommodate waste. The end seals 45 are attached to end wall 46 at pivot 47, near adjacent drum 23. At the upper end of the seal 45, a spring 48 urges the seal leading edge 49 into close proximity to traveling fabric 19. An adjusting screw 80 attached to the end seal 45 through nut 80*a* and stop 81 fixed to the wall 46 permits adjustment of the clearance between the seal leading edge and the fabrics. The leading edge 49 may be contoured to reasonably conform to the path that the fabric-web actually travels between the dryer drums.

Figure 6:
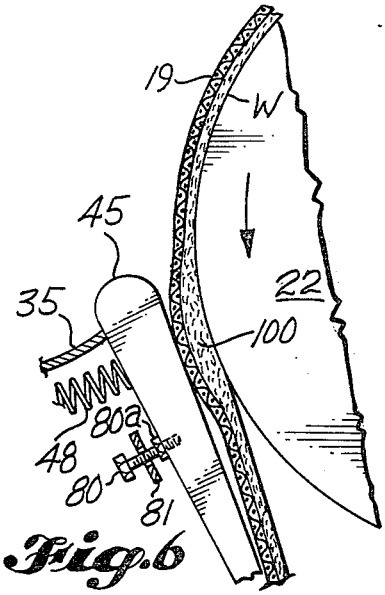
FIG. 6 is a detail view of an end seal deflected from its normal operating position by a paper wad.

FIG. 6 demonstrates what happens when a wad of waste paper 100 passes about the drum between the cylinder surface of drum 22 and the fabric. The end seal 45 is forced by the fabric 19 to pivot away from its normal position. After the wad passes, the spring 48 urges the seal back into its original position.

The wad 100, upon issuing from between the drying cylinder and fabric, drops clear. Wads are not a problem at the bottom cylinders as the sheet is on the outside of the fabric where it wraps the bottom cylinders.

As noted previously, air currents are created by the moving cylinders and flow adjacent to the moving equipment. In conventional designs, "bulges," wherein the web is slightly separated from its fabric, tend to occur at certain locations, as for example, where the web-fabric combination approaches and departs a drying drum. While static deflectors in the dryer cylinder "pockets" may reduce this problem, the vacuum box design of this invention is more positive and controllable.

It is advantageous to shape certain portions of the vacuum box 30 to deflect some of the air flow. The top surface 35 of the box 30 is formed into a curved surface to assist in deflecting air from entering the pocket area between the drums. Reduction in the amount of air that enters the pocket area reduces the amount of vacuum required and, hence, energy that must be provided to create the differential pressure necessary to hold the web onto its supporting fabric.

Figure 7:
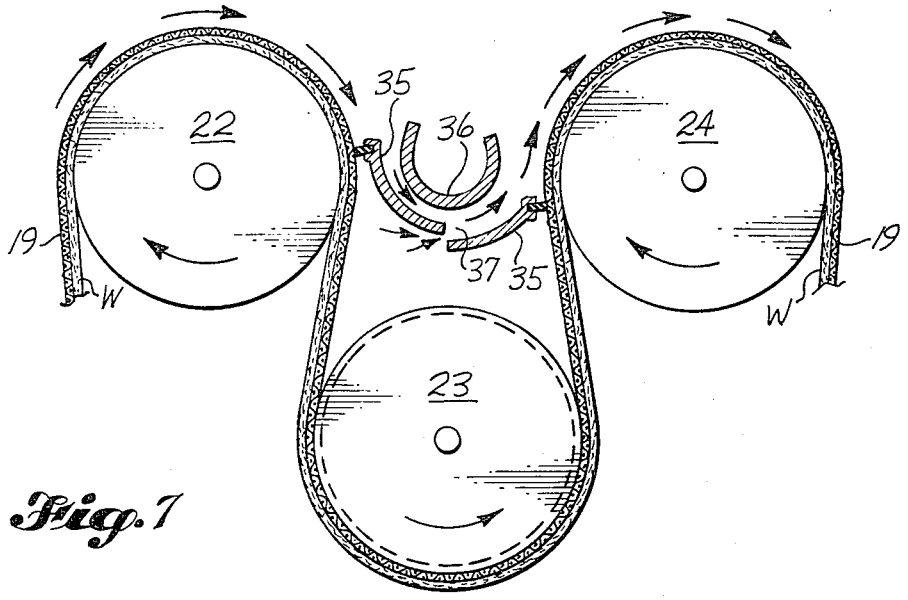
FIG. 7 is a side elevation schematic showing a vacuum box having a self vacuum generating capacity.

At high paper machine speeds, there will be enough air flowing with the dryer fabric to permit the design of a box that creates its own vacuum. This type of box is shown schematically in FIG. 7. The vacuum is created by directing the air flow through a venturi throat created by foil 36 and box surface 35 which causes a negative pressure differential at an opening 37 which draws on the web-fabric zones of the box.

Figure 8:
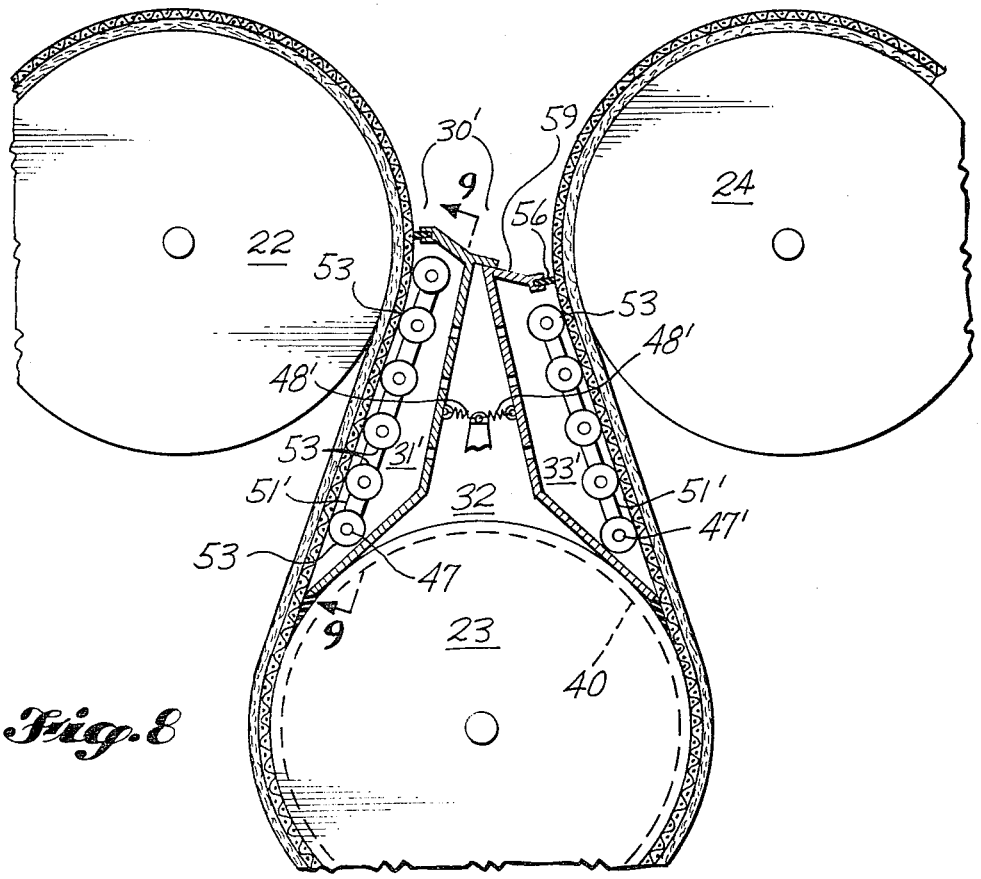
FIG. 8 is a side elevation view of a vacuum box having rotating surfaces against which the fabric bears.
Figure 9:
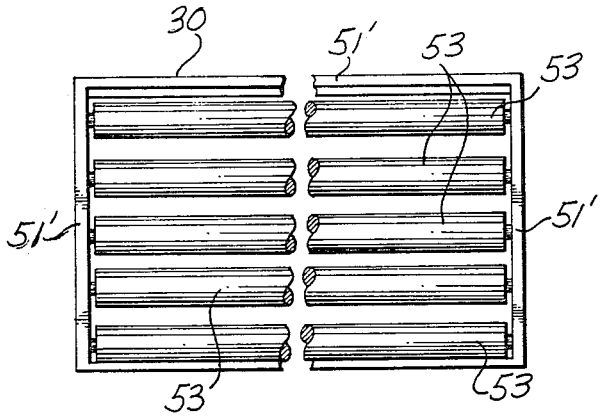
FIG. 9 is a sectional view of FIG. 8 along sectional lines 9—9.

In FIGS. 8 and 9, a vacuum box embodiment 30' is shown wherein a number of rotating roller bearing surfaces 53 are fixed in a supporting framework 51' of box 30'. The object of the bearing surfaces 53 is to reduce fabric rubbing problems at relatively low operating speeds. The fabric is supported on bearing rollers 53 as it travels through vacuum zones 31', 33'. Sealing means 56, substantially identical to those shown in FIGS. 3 and 5, reduce leakage between the fabric 19 and the top 59 and end wall (not shown). In a manner similar to the end seals 45 of FIG. 5, this arrangement requires that the entire framework 51' holding bearing surfaces 53 be pivoted about a pivot near 47' and urged into position by springs 48' to accommodate possible waste and avoid damage to fabrics and the box. The box top 59 is designed to permit the independent pivoting of either zone bearing surfaces. As shown, one portion of the top 59 slides over the other top portion to accommodate these waste clearing movements.

The pressure differential or vacuum force required to hold the web to its fabric as it passes about a dryer cylinder subjected to centrifugal velocity stressing forces may be calculated from the centrifugal force analysis demonstrated above. Using the formula for stress on the sheet developed above, the amount of vacuum necessary to overcome velocity-induced or centrifugal forces acting on the sheet as it passes unsupported at any point in the papermaking process or about the periphery of a drum may be calculated. For newsprint having a basis weight of 50 gms/m$^2$ at 40% dryness, passing about a drum having a radius of 0.915 meter at a speed of 1500 m/min., a force of 0.87 cm of water applied to the entire sheet area is required to hold the sheet onto its fabric. For a heavier weight paper, such as 120 gms/m$^2$, the requirement is 2.1 cm of water. A power demand of about 15 HP is required to remove the volume of air contemplated by the above-described conditions.

Start-ups of the paper machine either initially or after a break in the web conventionally require first establishing a "tail" of the web, about 1.0 ft. (0.3 m) in width, through the machine. Once the tail is established, it is generally increased in width until the full width of the web in running through the machine.

During start-ups with little or no web in the machine, the vacuum boxes of this invention draw a large amount of air through generally very porous fabrics. To reduce pumping costs the vacuum system may be operated with two vacuum pumps. A large volume pump would be used during high demand start-ups. After complete threading of the web a smaller pump would maintain the vacuum necessary. Both pumps might operate initially with the larger shutting down at completion of threading.

As an alternative, to reduce air volumes that must be evacuated during start-up, internal compartmentalization of each vacuum box with appropriate valving may be utilized.

Figure 10:
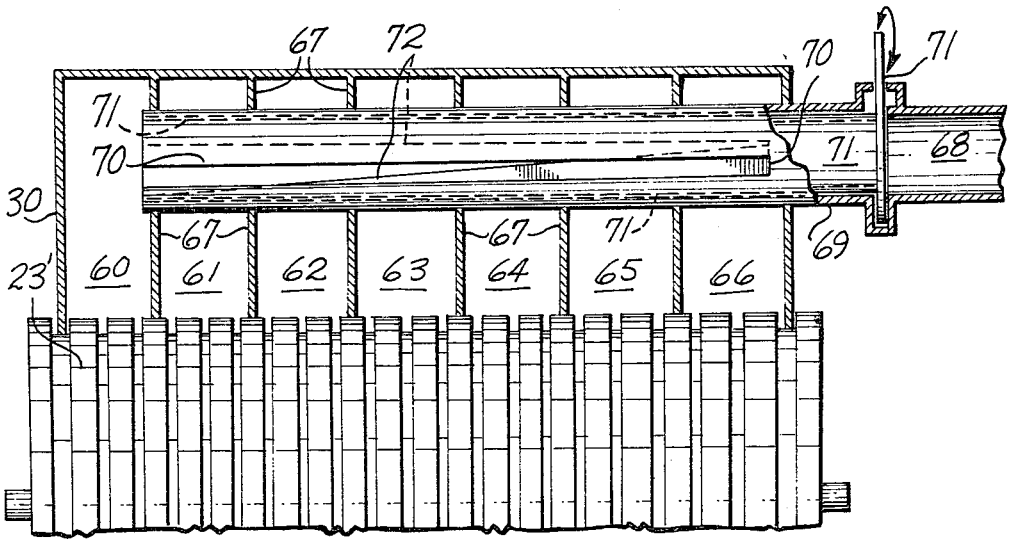
FIG. 10 is a partial side elevational view of a compartmentalized vacuum box permitting reducing vacuum demand during start-up.

As shown in FIG. 10, the vacuum box 30 may be divided into a number of compartments 60–66 by vertical walls 67. A vacuum distributor 68 communicates with each compartment 60–66 through a pipe or conduit 69, having slot 70 extending into each compartment. A valve element 71 comprises of a second pipe or conduit fitting inside pipe 69. Valve element 71 has a variable area slot 72 cut along its length to control the vacuum service to each compartment. The dimensions of slot 72 vary depending upon the distance the adjacent compartment is from the area where the initial portion of the web or "tail" runs on start-up. Thus the slot 72 is widest at compartment 61 which corresponds to the portion of the paper machine through which the start-up tail passes. Upon start-up, the end compartments 60,61 are open to vacuum service 68. The other compartments are subsequently opened, progressively from left to right, as valve element 71 is rotated in pipe 69 as the width of the web running in the machine increases.

Figure 11:
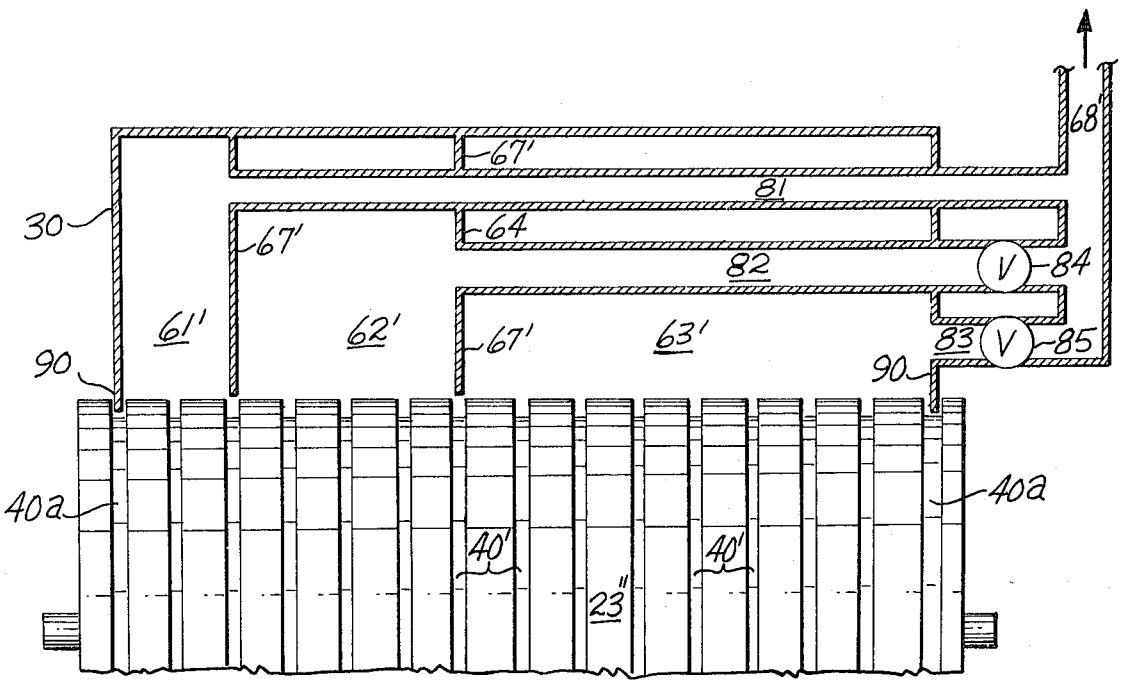
FIG. 11 is a partial side elevation view of an alternative valving system to that shown in FIG. 10.

FIG. 11 shows an alternative method of controlling vacuum flow across the width of the paper machine. Here a separate line 81, 82, 83 runs to each compartment 61', 62', 63' from the vacuum source means 68'. Each line 82, 83 is provided with a valve 84, 85, which controls which compartments will be evacuated during start-ups.

FIG. 11 shows drying cylinder 23'' having grooves 40'. There may be a larger number of grooves 40' at the outer ends of the cylinder 23'' to ensure good holding forces at these stressful locations and to accommodate sheet width variations. A special circumferential groove 40*a* may be cut into the outermost surface of the drying drum to accommodate the outer edge 90 of the vacuum box 30, which groove and edge would act as a seal to reduce air leakage into the vacuum box. The grooves 40 should be staggered with respect to the overall drying process so that the sheet is generally uniformly treated as it passes through the machine.

An alternative to the circumferential grooves 40 cut into drying cylinders is to employ a special dryer fabric having longitudinal, with respect to the machine, ridges built into its structure on the side opposite to that carrying the paper web. The spaces between the ridges serve the same function as the grooves in the cylinders. The fabric must be permeable in order for the vacuum to communicate through the fabric and hold the web or sheet to it.

The grooved, heated lower cylinders may, as an alternative, be replaced with cylinders having foraminous major surfaces. For example, the bottom of the grooves 40 of the cylinders may be apertured about their circumference. A vacuum on the cylinder interior then evacuates the grooves thereby holding the web and fabric combination together onto the cylinder outer surface, independent of centrifugal or other velocity stresses. The foraminous cylinders may be of relatively light weight construction since they do not have to withstand conventional stream pressures.

The drying rate of drum dryers is dependent upon the arc of contact or degree of wrap of the paper web about the heat transfer surface of the drum. In the conventional paper machine, where the paper web is unsupported between drums, the actual arc of contact is considerably less than suggested by the geometry of the layout. The air bulges, noted above, at the approach and departure of the web from the drum tend to separate the web from heat transfer contact with the drum surfaces. The introduction of a supporting means for the web during drying increases the arc of contact at the top cylinders, but results in interposing the fabric between the cylinder and web on the bottom cylinders. The air currents and centrifugal forces operating on the system in this lower dryer region tend to separate the web from its fabric where it nears and passes around the bottom cylinders, greatly reducing the drying achieved by the bottom cylinders. Bringman and Jamil, "Engineering Considerations for Lightweight Paper Drying in High Speed Machines," Paper Technology & Industry—UK Vol. 6, pp. 198–200 July–August 1978). The pressure differential surface zones at suction box surfaces 31, 32 and 33 of the present invention cause the web W to engage in greater contact, with the lower drums 21, 23 and 25, for example, than possible with previous conventional supporting systems. This permits more heat to be transferred to the web through the fabric. The proximity of the sheet to these lower pressure zones increases the thermodynamic forces driving water vapor from the sheet into the low pressure adjacent areas. The combination of a greater arc of contact on the top cylinders, more effective contact at the lower cylinders and lower pressures adjacent the sheet in the vacuum boxes and grooved lower cylinders results in drying rates above those obtainable with present conventional or serpentine fabric arrangements.

The improved contact and low pressure adjacent the sheet offsets the loss due to the indirect heat transfer contact between the web and the drum surfaces at the lower drums. It is well known that at any temperature water evaporates into the air at a faster rate at lower pressures than at higher pressures. The vacuum boxes and grooved cylinder combinations provide a low pressure condition adjacent the web that, in effect, increases the drying rate and capacity of a given number of drying cylinders and improves energy efficiency. Thus, this invention avoids the solution of Mahoney, which adds extra heat to the lower rolls which is less energy effective. Also, the advantageous solution of this invention is attained without the more complex solution shown in the prior art, for example, Soininen.

EXAMPLE 1: Mill Economics

A review of the economics of the design of the invention depicted in FIG. 2, compared with those of a current, conventional process, shows the advantages of the new design. Here the advantage highlighted is the choice of a furnish containing a reduced amount of the more expensive bleached kraft chemical pulp which is typically included to improve the wet processing strength of the web.

The following table of relative costs for a 750-ton-per-day operation for making newsprint shows a $27/ton improvement over conventional technology as a result of reducing the chemical pulp fiber content of a finished newsprint from 15% by weight to 5%. The machine speed remains the same for both the process of the invention and the conventional technology. The reduced chemical pulp furnish results in a weaker sheet during initial drying, but the supporting and holding means of this invention permit the web to be processed at the same speed as if it were a stronger sheet or even faster if desired and the machine has the required drying capability. The following table illustrates the savings due only to reduced chemical pulp demand.

TABLE

| Relative Costs Per Ton of Newsprint Produced | | | |
|---|---|---|---|
| Costs | Process of the Invention ($/ton) | Conventional Process ($/ton) | Benefit of Invention ($/ton) |
| Power, $0.02/KWH | 57 | 51 | −6 |
| Chemical Pulp @ $450/ton | 22 (5% of furnish) | 67 (15% of furnish) | +45 |
| Chips, TM @ 120/ton | 114 (95% of furnish) | 102 (85% of furnish) | −12 |

TABLE-continued

| Relative Costs Per Ton of Newsprint Produced | | | |
|---|---|---|---|
| Costs | Process of the Invention ($/ton) | Conventional Process ($/ton) | Benefit of Invention ($/ton) |
| Total | $193 | 220 | 27 |

At an operating rate of 750 tons/day, 350 days/year, the savings amount to $7.1 million per year using typical costs of power, chemical pulp and chips.

Alternatively, of course, the speed of the drying section may be increased, the other components of the papermaking process permitting. Every 100 ft./min. (30.5 m/min.) increase in effective speed is equivalent to an increase in production benefit of about $1 million per year for a large size newsprint machine.

Saleable newsprint is presently being made from 100% thermomechanical pulp but at low production speeds by today's standards. The fastest newsprint machine today achieves an average operating speed of 3650 ft./min (1122 m/min.) using 38% chemical pulp. The process of this invention will be able to attain 5,000 ft./min (1525 m/min) without the necessity of using substantial amounts of chemical pulps.

A combination of reduced chemical pulp requirement and speed increases has the potential to increase the return of the largest newsprint machines by in excess of $45 million per year at current pulp and energy costs.

EXAMPLE 2: Pilot Machine Trials

The pilot machine comprises a complete one meter wide paper machine using a Sym-Former producing a paper sheet about 600 mm in width. The web is formed and pressed in an arrangement similar to that shown in FIG. 2. The machine is provided with eleven cylinders in the dryer section arranged as shown in FIG. 2. The solid surfaced cylinders are electrically heated rather than conventionally steam heated. The bottom cylinders have grooved surfaces. A vacuum box (not shown in FIG. 2) holds the sheet onto its supporting fabric during transport of the web from the transfer roll (which transfers the web from the press belt onto the dryer fabric) up to where the web is brought into direct wrapping contact with the first heated drying cylinder. Vacuum boxes similar to that depicted in FIG. 3 occupy the dryer "pockets" as shown in FIG. 2.

The following tables and observations are pilot trial results using various strength furnishes to produce certain typical paper products at varying machine speeds.

Trial A Corrugating Medium

The target paper was corrugating medium at 127 grams per square meter (g/m$^2$) basis weight.

The furnishes tested were 100% hardwood pulp made by a conventional green liquor semichemical pulping process. At 37° C., this pulp furnish had a wet web strength, at 35% solids, of 20 BLM (breaking length, meters). In a second group of trials the hardwood pulp was blended with a strong chemical kraft pulp consisting of a bleached sulphate process pulp made from a long fiber softwood. The furnish containing 80% hardwood and 20% kraft pulp had, at 37° C. and 35% solids, a wet web strength of 40 BLM.

In the corrugating medium trials, the press belt 15 shown in FIG. 2 was used to transport the web from the last nip until transfer by suction roll 18 onto dryer fabric 19. During trials of the process and equipment of this invention a pressure differential was established at vacuum boxes 30, including the additional box operating between the point of transfer of the web onto a supporting dryer fabric and its contact with the first drying cylinder. Referring to FIG. 3, the second suction box in the pilot machine was equipped with vacuum gauges located at points a–d. Table I shows vacuum at points a–d for a drying fabric having a permeability of 500 m$^3$/m$^2$h (at $\Delta P = 100$ Pa).

TABLE I

| VACUUM BOX PRESSURES | | | | | | |
|---|---|---|---|---|---|---|
| | | Pressure Differential (See FIG. 3, Points of Measurement) | | | | |
| Trial | Speed m/s | a | b | c | d | e |
| Without paper web on machine | 12.5 | 460 | 160 | 210 | 50 | 30 |
| Same as above | 15.0 | 430 | 160 | 180 | 40 | 20 |
| With paper web on machine | 12.5 | 720 | 310 | 400 | 400 | 400 |

A tension was exerted on the fabric to prevent rubbing between the fabric and the vacuum boxes. A tension of about 3 kN/m was sufficient when vacuum box pressures were on the order of 500 Pa. At speeds above 15 m/s, suction in the vacuum boxes had to be increased to 700–800 Pa. This vacuum caused some fabric rubbing at the seals, until the seals were readjusted.

The necessity of using the vacuum boxes was demonstrated by shutting them off during a number of trials. When the boxes were shut down, conditions similar to conventional paper machine environments were quickly established resulting, in general, in sheet breakages. Table II presents the results of these trials at increasing speeds for both the 100% hardwood and 20% kraft furnishes.

TABLE II

| CORRUGATING MEDIUM, 127 g/m$^2$ | | | |
|---|---|---|---|
| Furnish | Machine | Process & Equipment of Invention | |
| (Species mix, wt. %) | Speed (m/s) | Vacuum System Operating | Vacuum System Shut Down |
| 100% hardwood | 7.5 | Satisfactory Run | Sheet break-machine down |
| 100% hardwood | 10.0 | Satisfactory Run | Sheet break-machine down |
| 100% hardwood | 12.5 | Satisfactory Run | Sheet break-machine down |
| 20% kraft and 80% hardwood | 12.5 | Satisfactory Run | Satisfactory Run[1,2] |
| 20% kraft and 80% hardwood | 15.0 | Satisfactory Run[3] | Sheet break-machine down |

Notes:
[1]Transfer suction roll off.
[2]Sheet separated slightly from fabric on last three bottom cylinders even though draw increased to 2.8%.
[3]Transfer suction roll off.

Transfer of the web from the press belt onto the dryer fabric was generally without difficulty. In some cases it was possible to shut down transfer roll vacuum without adversely affecting transfer. The suction in the vacuum transfer roll ranged from 0 to 100 Pa. If a good transfer off the press belt could be obtained, then no suction was used at the transfer point. At 100 Pa in the box some rubbing of fabric on the box surfaces was experienced.

A slight longitudinal stress or "draw" was exerted on the web at the point of transfer from the press belt. The draw was established by operating the transfer roll and dryer fabric combination at a higher speed than the press belt speed. The amount of draw exerted on the web is expressed as a percentage representing the speed differential between the press and dryer sections. The draw differentials were 0.5–2.3%, and preferably 1–2%. Too low a draw resulted in wrinkle defects in the paper product. Too high a draw resulted in web breaks and machine shutdowns. A 1.5–2% draw was applied, except where noted, in the pilot trials.

In general, runnability was good when the vacuum boxes of the invention were operating. This is indicated in Table II by the "Satisfactory Run" observation. Shut-down of the boxes resulted in the web separating from its supporting fabric at all speeds, leading in all but one case to failure of the sheet. The time between suction shutdown and web breaks was about 0.5–1.0 minute.

Table II demonstrates that weak hardwood furnishes can be run where the paper machine uses the supporting and holding process and equipment of this invention. When the holding systems were shut down, this furnish could not be run at the test speeds. For a 20% kraft furnish, speeds of 15.0 m/s were attained for the process and equipment of the invention. The furnish could be run without the vacuum box holding means operating at 12.5 m/s. However, at this speed the web had separated from its supporting fabric on the last three bottom drying cylinders. The separated web was thus subject to machine velocity stresses and susceptible to breakage should, for example, inherent wet web strength decrease or speed be increased. Increasing machine speed to 15.0 m/s did, in fact, result in web failure when the vacuum holding forces were cut off.

The fastest machine making corrugating medium today operates at a maximum speed of 10.7 m/s (2100 ft./min.) and average 9.9 m/s (1950 ft./min.). These speeds are only attainable when the furnish includes about 30% expensive chemical pulp to improve wet strength. The pilot machine trial results demonstrate a 40% speed increase. A 16.8% speed increase was attained with the furnish from which all chemical pulp had been excluded.

Trial B—Fine Paper

The target paper in this group of pilot machine trials was a fine paper of 74 g/m$^2$, having a filler content of 12%.

The furnishes tested ranged from 100% hardwood to furnishes containing 30% kraft. The hardwood pulp for this trial was a bleached sulphite pulp made from a 1 to 1 mixture of mixed northern dense hardwood and aspen. At 39° C., 35% solids, this pulp has a wet web strength of 39 BLM. The strong chemical pulp used to improve wet web strength of the hardwood furnish for these trials was a bleached sulphate kraft pulp made from a long fiber softwood. A 30% kraft, 70% hardwood furnish has a wet web strength of 59 BLM at 39° C., 35% solids.

In the fine paper trials, the paper machine arrangement was as described above. Vacuum box suctions were increased to 1000–1500 Pa, which caused some rubbing between the fabric and box surfaces. Table III shows how this pressure was distributed in the vacuum box for two different fabric permeabilities.

TABLE III

FINE PAPER TRIAL VACUUM BOX PRESSURES

| Fabric Permeability ($m^3/m^2h$, $\Delta P$ = 100 Pa) | Conditions of Trial | Speed (m/s) | Pressure Differential (See FIG. 3 a | b | c | d | e |
|---|---|---|---|---|---|---|---|
| 100 | without paper web | 12.5 | 1,150 | 12 | 950 | 850 | 650 |
| 100 | with paper web | 12.5 | 1,300 | 96 | 1,220 | 1,310 | 1,420 |
| 500 | without paper web | 15.0 | 510 | 100 | 230 | 40 | 40 |
| 500 | with paper web | 15.0 | 860 | 140 | 510 | 500 | 530 |

A draw of about 1.5–2.0% was used to keep the sheet wrinkle free on the dryer.

Table IV presents the results of pilot trials for the various furnishes at increasing machine speed.

TABLE IV

FINE PAPER, 74 g/m$^2$

| Furnish Species mix, wt. %) | Machine Speed (m/s) | Process & Equipment of Invention: Vacuum System Operating | Vacuum System Shut Down |
|---|---|---|---|
| 100% hardwood | 10 | Satisfactory Run | Satisfactory Run[1] |
| 100% hardwood | 12.5 | Satisfactory Run | Sheet break, machine down |
| 100% hardwood | 15 | Satisfactory Run | Sheet break, machine down |
| 5% kraft 95% hardwood | 10 | Satisfactory Run | Satisfactory Run |
| 5% kraft 95% hardwood | 12.5 | Satisfactory Run | Sheet break, machine down |
| 5% kraft 95% hardwood | 15 | Satisfactory Run | Sheet break, machine down |
| 30% kraft 70% hardwood | 12.5 | Satisfactory Run | Satisfactory Run[2] |
| 30% kraft 70% hardwood | 15 | Satisfactory Run | Sheet break, machine down |
| 30% kraft 70% hardwood | 17.5 | Satisfactory Run | Sheet break, machine down |

Notes:
[1]With increased draw.
[2]Sheet separated slightly from fabric on last three bottom cylinders, even though draw increased.

The fine paper furnishes were somewhat more difficult to transfer from the press belt onto the dryer fabric. A 30 kPA (maximum) suction at the transfer roll was required to affect transfer, in contrast to the corrugating furnishes which could often be transferred without any suction on at the transfer roll at all. A somewhat stronger draw on the paper web, on the order of 2.5%, was sometimes required with the fine furnish.

Dryer section runnability with the finer paper furnish was worse that with the corrugating furnish. There was a strong tendency for the fine paper furnish web to adhere to the drying cylinders because of the characteristics of the pilot machinery. As noted earlier, vacuum box suction had to be increased considerably.

Referring to the Table IV results, the 100% hardwood furnish trials show the greater inherent strength of the furnish. Thus, the furnish would run, without the vacuum boxes exerting holding forces on the web, at 10 m/s. However, when the speed was increased to 12.5 m/s, web breakage was experienced when the vacuum boxes were shut down. With the boxes operating, the web ran satisfactorily at 12.5 m/s and also at 15 m/s (the highest speed attempted). When the vacuum boxes were shut down, the sheet broke at 12.5 m/s.

At this point in the trial the furnish was modified to improve its wet web strength to determine how much kraft chemical pulp would be needed to allow the machine to operate without the vacuum box holding means of the invention. Not until the kraft pulp content had reached 30% was the web able to run at 12.5 m/s without the holding means of the invention. However, when the speed was increased to 15 m/s, the sheet broke when the vacuum boxes were shut down. With the vacuum box holding force operating on the web to hold the web onto its supporting fabric, the web was run satisfactorily at 15 m/s and even at 17.5 m/s. CL Trial C—Newsprint 50 g/m$^2$ The objective of this trial was to produce newsprint at 50 g/m$^2$ at high production speeds.

The furnish comprised 44% groundwood pulp, 44% thermomechanical pulp and 12% kraft chemical pulp.

The identical arrangement described above was used in the trials. It was found that the following "draw" was necessary to obtain satisfactory newsprint.

TABLE V

| Speed Difference Between Press Section and Dryer Section | |
|---|---|
| Speed m/s | Speed Difference at Transfer Point |
| 15.0 | 1.5 ± 0.5% |
| 17.5 | 2.0 ± 0.5% |
| 20.0 | 2.6 ± 0.6% |

The highest speed attainable, where the sheet could be reliably produced was, 20 m/s (3937 ft/min). Speeds of 22 m/s/ (4331 ft/min) could occasionally be established but tended to break at transfer from the press to the dryer section. The speed improvement over conventional speeds was limited by the lack of suitability of the press belt (FIG. 2, element 15) for effecting a relatively tensionless transfer of the newsprint furnish used into the dryer section.

In sum, the pilot trial results demonstrate the operation of the processes and equipment of the invention. The results show that the invention operates largely independent of the inherent strength of the furnish being processed. The trial results show that this advantage is in distinct contrast to prior art processes, represented by trials in which the vacuum box holding forces were shut off.

The speed increasing benefits of the process and equipment of the invention were likewise demonstrated by the pilot trials. The upper limits of the speed improvements contemplated were not attained in these trials because of equipment limitations described above. The speed improvements contemplated are limited only by process or equipment limitations that are unrelated to velocity stresses.

The improvement of this invention may also be translated into several other productivity advantages. For example, the capital cost for a new machine may be reduced for a given capacity since all elements of the machine might be reduced in width because of the higher production speed of the new machine. The advantages of this invention are readily retrofitted onto existing conventional paper machines.

What is claimed is:

1. In a paper machine of the type having drying cylinders to dry a paper web and a supporting fabric means for transporting the web in partial wrapping direct and indirect contact with the heated cylinders, an improved vacuum box means for holding said web to said fabric means on all portions of said web where said web would otherwise be subjected to velocity forces in traveling from cylinder to cylinder and about fabric-wrapped cylinders, said vacuum box, comprising:

a fixed surface means for deflecting machinery-generated air currents from impinging upon the paper web and supporting dryer fabric, said surface extending, across the width of the paper machine, substantially between adjacent web-wrapped cylinders, the leading edge of which surface, with respect to machine direction, leads the line of departure of said web and fabric from the web-wrapped cylinder and the trailing edge of said surface extends at least until said web and fabric contact the subsequent web-wrapped cylinder;

end wall means for preventing air flow into the ends of said vacuum box, said walls coincident with the outer machine direction edges of the fixed air deflecting surface means, said walls extending closely adjacent to said fabric-wrapped cylinder, and extending adjacent the web-supporting fabric traveling between the web- and fabric-wrapped cylinders but sufficiently distant from said fabric that paper web waste passing between cylinders and said wall cannot cause said fabric to contact said wall;

sealing means, between said vacuum box and said fabric and cylinders, for limiting air leakage into said box while permitting the passage of waste paper between said box and drying cylinders without damage to said box, fabric or sealing means; and a means for causing the pressure differential in said vacuum box sufficient to hold said web to said supporting fabric.

2. The vacuum box means of claim 1, wherein said sealing means comprises:

fabric seal means for approaching as close as practical the web-supporting fabric means across the width of the paper machine, said fabric seal means being flexible and resilient, approaching said fabric where said web is in contact with a cylinder surface, each of said seals of sufficient machine direction dimensions to accommodate paper waste passing between said box surfaces, fabric and cylinder surfaces by flexing in response thereto and returning to its sealing position after said waste has passed by said seal; and end seal means for sealing the ends of the vacuum box between said fabric and said end wall means, said seals having leading edges substantially conforming to the path travelled by the paper web supporting fabric as it travels from a web-wrapped to a fabric-wrapped cylinder, and trailing edges of said seals overlapping said end wall, said seal being pivotally mounted upon said end wall means near the fabric-wrapped cylinder with a spring means near the web-wrapped cylinder urging said seal leading edge as close as practical to said fabric, whereupon said pivot and spring interact to permit passage of waste paper between the web-wrapped cylinder and the vacuum box end seals without damage to the vacuum box, fabric or seal.

3. The vacuum box means of claim 1, wherein said vacuum box is provided with roller surfaces for supporting said fabric as it travels between a web-wrapped cylinder and a fabric-wrapped cylinder, said surfaces, comprising:

a framework defining pressure differential zones between said web-wrapped cylinders and said fabric-wrapped cylinders; and roller surfaces, mounted in said framework free to rotate at the speed of the traveling fabric wherein said roller surfaces bear against said fabric during its passage between the web-wrapped and fabric-wrapped cylinders, said roller surfaces minimizing friction between said fabric and said vacuum box means;

wherein said framework is pivoted near said fabric-wrapped cylinder in order to pivot away from said web-wrapped cylinder to accommodate passage of waste paper between said cylinder and said vacuum box surfaces without damage to either, said framework being further provided with a spring means to urge said roller surfaces into contact with said fabric.

4. The vacuum box of claim 1, wherein said second pressure differential means for holding said web and fabric to said fabric wrapped cylinder, comprises:

a foraminous surfaced cylinder; and a means for causing a pressure differential in said cylinder, wherein said differential causes said web and fabric to be in supporting contact with said foraminous surfaced cylinder.

5. The vacuum box means of claim 1, wherein said pressure differential means and fixed surface means, comprises:

a concave, contoured top surface of said vacuum box between adjacent web-wrapped cylinders, said surface substantially opposite said zone adjacent said fabric-wrapped cylinder, wherein said top surface is apertured; and a second concave surface positioned adjacent said top surface, wherein the two surfaces create a venturi throat at said aperture and air currents, generated by moving fabrics and cylinders, passing therethrough, provide pressure differential forces to hold said web to said web-supporting fabric at said pressure differential zones.

6. The vacuum box means of claim 1, wherein said vacuum box means is divided internally into separate pressure differential zones which may be operated at different pressure differential levels, said vacuum box means, comprising:

wall means for separating each pressure differential zone to be operated at a different pressure differential level from adjacent zones; and pressure regulating aperture means in said walls, permitting communication between adjacent pressure differential zones, wherein said means for causing a pressure differential, operating directly on the pressure differential zone requiring the highest pressure differential level, to accomplish its function of holding said web to its supporting fabric, causes sufficient pressure differential force levels in the remaining pressure differential zones by leakage through said pressure regulating aperture, to permit all zones to accomplish their web-holding functions.

7. The vacuum box means of claim 6, wherein one of said pressure differential zones comprises:

a zone adjacent the portion of the surface of said fabric-wrapped cylinder not wrapped by said fabric means, said zone acting to hold said web and fabric to said cylinder surface through a plurality of circumferential grooves formed about the surface area contacted by said cylinder-wrapping fabric, said circumferential grooves formed by said fabric having longitudinal ridges formed into the surface of said fabric bearing against the surface of said cylinder.

8. The vacuum box means of claim 6, wherein:

said pressure regulating means comprises an orifice fitted with a pressure differential adjusting plate.

9. In a paper machine of the type having drying cylinders to dry a paper web and a supporting fabric means for transporting the web in partial wrapping direct and indirect contact with the heated cylinders, an improved vacuum box means for holding said web to said fabric means on all portions of said web where said web would otherwise be subjected to velocity forces in traveling from cylinder to cylinder and about fabric-wrapped cylinders, the improvement for reducing vacuum demand during initial threading of the web through the paper machine wherein initially threading the paper machine requires first establishing a narrow width portion of the paper web throughout the machine followed by gradually increasing said web in width until a full width web is established, comprising:

wall means for internally dividing said vacuum box means into compartments across the width of said machine; and a control means for controlling evacuation of each compartment by said pressure differential means, wherein, upon initially threading the machine, only those compartments coinciding with the initial web portion are evacuated, the remaining compartments being evacuated as the threading progresses and the web is increased in width.

10. The paper machine of claim 9, wherein said control means comprises:

a separate conduit means for each of said compartments communicating with said pressure differential means; and a valve means for each conduit means for each of said compartments communicating with said pressure differential means.

11. The paper machine of claim 9 wherein said control means comprises:

a first conduit means, communicating with said pressure differential means, extending the width of said vacuum box, said conduit having a first slot therein providing communication with each compartment; and a second conduit means mounted inside of and concentrically with respect to said first conduit means, said second conduit means having a variable width slot therein, wherein rotation of said second conduit with respect to said first conduit permits alignment of the second variable slot means with the first slot means so that said pressure differential means evacuates certain compartments initially and the remaining compartments as the second conduit means is further rotated in said first conduit means with respect to said first slot.

* * * * *